US007865098B2

(12) United States Patent
May

(10) Patent No.: US 7,865,098 B2
(45) Date of Patent: Jan. 4, 2011

(54) SMART DEVELOPER CYCLE UP

(75) Inventor: Keith A May, Palmyra, NY (US)

(73) Assignee: Xerox Corporation, Norwalk, CT (US)

( * ) Notice: Subject to any disclaimer, the term of this patent is extended or adjusted under 35 U.S.C. 154(b) by 70 days.

(21) Appl. No.: 12/362,808

(22) Filed: Jan. 30, 2009

(65) Prior Publication Data

US 2010/0196031 A1 Aug. 5, 2010

(51) Int. Cl.
*G03G 15/01* (2006.01)

(52) U.S. Cl. ..... 399/54

(58) Field of Classification Search ..... 399/38–42, 399/53–56, 91, 94, 97
See application file for complete search history.

(56) References Cited

U.S. PATENT DOCUMENTS 6,862,418 B2 * 3/2005 Morita et al. ..... 399/223
7,079,794 B2 7/2006 Forbes, II et al.
7,085,506 B2 8/2006 Forbes, II et al.
7,177,557 B2 2/2007 Kreckel
7,239,829 B2 * 7/2007 Tanaka ..... 399/167
7,263,301 B2 8/2007 Martin et al.
7,706,731 B2 * 4/2010 Martin et al. ..... 399/298

* cited by examiner

*Primary Examiner*—Hoan Tran
(74) *Attorney, Agent, or Firm*—Ronald E. Prass, Jr.; Prass LLP

(57) ABSTRACT

This invention provides supplying a model that will together with software and a controller, separately selectively cycle up (activate) or cycle down (inactivate) color stations in accordance with their need for a particular imaging run. The cycled down stations are not activated for the imaging run thereby preserving the quality of the developer and toner in that inactivated color station or housing. The model will vary, depending on the machine or desired images. Each model can later be used for machines of the same family.

10 Claims, 1 Drawing Sheet

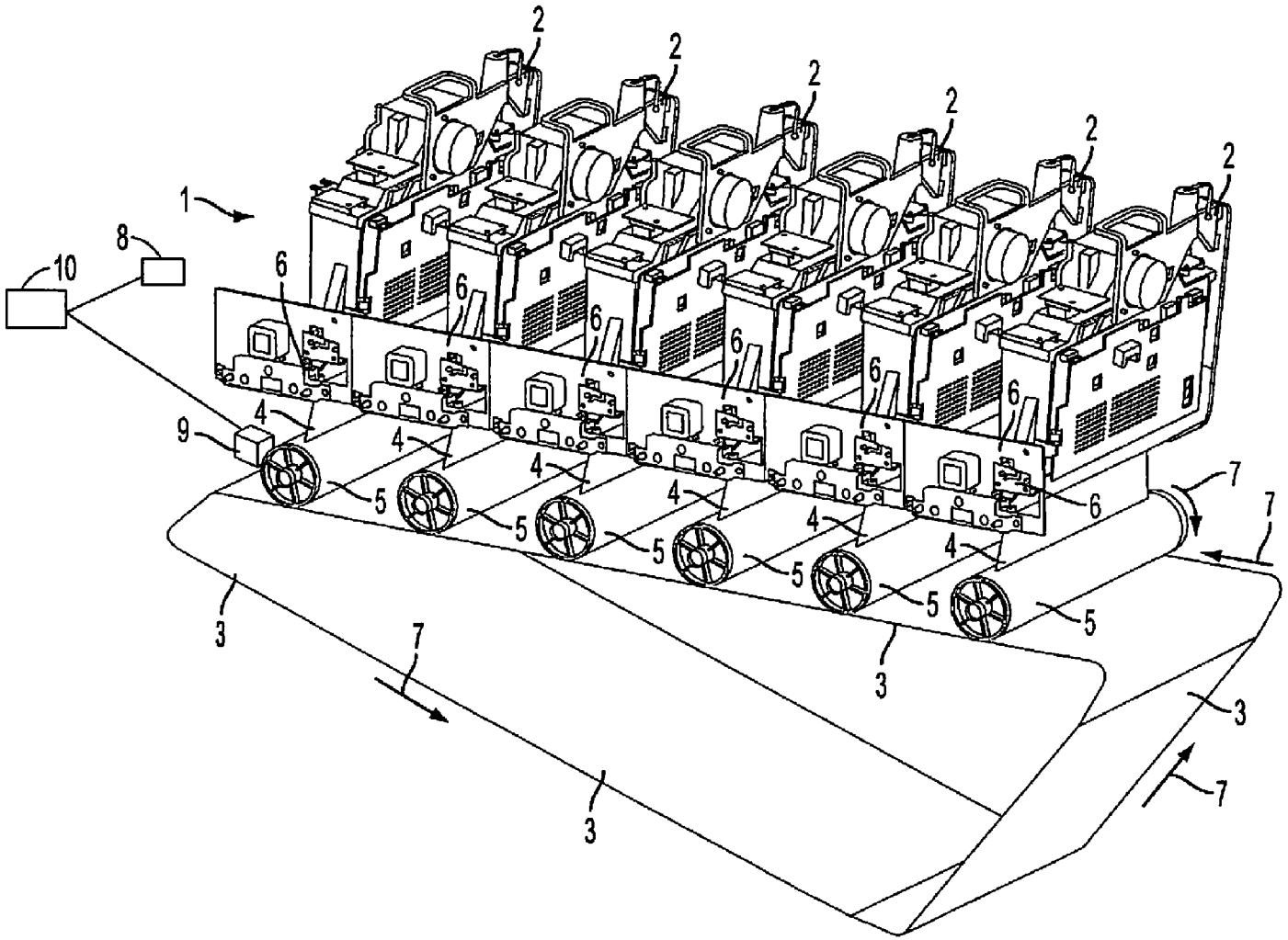
1
2
3
4
5
6
7
8
9
10

SMART DEVELOPER CYCLE UP

This invention relates to an electrostatic marking system and, more specifically, to the use of a model in the developer stations of an electrostatic color system.

BACKGROUND

A typical electrophotographic or electrostatograpic reproduction machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrostatic reproduction machine of this type to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image.

The resultant multi-color powder image is subsequently transferred to a sheet. The transferred multi-color image is then permanently fused to the sheet forming the color print. Generally, a color electrostatographic reproduction machine used 4-6 developer units.

In many electrophotographic products, if a developer housing is cycled up but not developing a reasonable amount of toner throughput it tends to cause the materials to degrade which can lead to other xerographic issues (e.g. poor toner developability). The desire is to cycle down one or more developer housings that are not currently needed and will not be needed for some extended period of time to reduce the material degradation. These developer housings need to be cycled back up in time for the next image that requires the particular colorant. The present difficulty is knowing how early to begin the developer housing cycle up and convergence process to ensure the housing(s) is ready in time.

Xerographic cycle up is an ordered sequence of actions necessary to bring the xerographic subsystem to a ready state and is generally accomplished in a predictable amount of time. This is then followed by the "xerographic convergence" process which takes a variable amount of time depending on the current xerographic conditions (e.g. toner age, PR belt age, etc.). To minimize toner material degradation, it is desirable to cycle down any developer housing(s) that will not be used for a certain minimum to be determined (TBD) amount of time. In Xerographic color processes, images are scheduled many seconds (image pitches) into the future. This information could be used to determine the situations when it would be appropriate to cycle down one or more developer housings that will not be needed for the coming job images. A "model" or prediction of the developer housing cycle up and convergence time is needed to ensure the developer housings are brought back online in time for the next image requiring that colorant. Otherwise, productivity will be impacted in the form of skipped pitches waiting for the xerographic subsystem to reach its ready state.

SUMMARY

This invention proposes the use of a "model" of the developer housing cycle up and xerographic convergence time which could be used to predict the time required to achieve a "ready" state for the xerographic subsystem. Having a "model" such as this would allow the xerographic color system to cycle down the unused developer housing(s) and then start the cycle up and convergence process in time to have the required developer housing(s) ready for the next image requiring its particular colorant. The ability to separately cycle up and down developer housings during a production run may be desired or required for highlight color and/or tandem printing configuration using certain families xerographic systems.

Central to this invention is the use of a "model" to predict the amount of time required to bring the color xerographic system to a ready state. This invention does not attempt to specify this model since every model for each generation machine will be different. The "model" could be a simple "time-averaging" model which utilizes the last N xerographic cycle up times to predict the average time required to bring the xerographic system to a ready state. This simple model may be adequate if the variance in cycle up and convergence times is small. However, if this model is optimistic then it could result in skipped pitches while waiting for longer actual cycle up and convergence times. A more sophisticated model encompassing actual xerographic properties (e.g. toner age) would probably result in a more accurate prediction, but at greater complexity and cost. Using the "model", the machine control software could intelligently cycle down any developer housings that will not be utilized for the pages currently being scheduled; thus reducing the "toner material degradation" that would otherwise occur if the developer housing remained cycled up. This, in turn, should improve machine availability for the customer and reduce service costs.

It is known that developers including toner degrades with increasing toner age and developer agitation. Cycled up stations that are not needed in the imaging run caused developers to be mixed and agitated thereby degrading developability characteristics. In order to ensure good developability, which is necessary to provide high quality images, toner age, in addition to other factors, must be considered.

Additionally, it has been found that it may be important to also monitor the age of the other component of the developer, the carrier. When carriers which are used in conductive or semiconductive magnetic brush development systems become encased in toner resin fines they may become too insulative to function properly, leading to poor development of solid areas. Alternatively, coatings on the carrier which are present to provide proper tribocharging of the toner, can wear off with the result that the carrier no longer functions as intended. The severity of either mode of degradation is proportional to how long the carrier has been in use; i.e. the carrier age. Monitoring the carrier age will allow one to take appropriate service actions based on the carrier age. Such actions may include, but are not necessarily limited to, adding extra raw carrier, to flush old material, using a special, high carrier content replenisher, or simply installing a new developer.

However, even if the developer materials are maintained in an optimal age state, it has been observed that when running low area coverage jobs the developability and/or transfer efficiency can fall off due to changes in the materials state in the developer housing. This fall off in developability and/or transfer efficiency produces weak, mottled and/or streaky images and can cause the process controls to use all of the printer's operating space in trying to correct the problems. With existing printing devices, when running low area coverage jobs and a reduced image quality suspected to result from a fall off in developability or transfer efficiency is observed, it is known to address the problem by either changing the materials within the developer housing(s) or by running a large number of prints (e.g. 1-2 thousand) of a high area coverage document to remove "bad" toner from the developer housings.

Although purging toner, replacing the materials within developer housing and/or running a large number of a high area coverage document can improve the developability and transfer efficiency and thus restore image quality, such procedures are both costly and time consuming as the user is forced to interrupt the job and perform some service action on the-printer. Additionally, the above processes can result in a time waste, a substantial waste of toner, carrier and/or paper resources. Furthermore, as the problem must first be identified and diagnosed by an operator before any corrective action can be taken, there is the possibility of a substantial loss in productivity resulting from the loss of a large number of pages before detection of a problem or from dedicating an operator to monitor the job to detect potential problems. Other problems associated with Xerographic developer degradation are outlined in U.S. Pat. Nos. 7,079,794; 7,085,506; 7,177,557, and 7,263,301. Most of the processes described in the processes of these prior art patents involve purging toner to maintain quality.

Below are listed some examples of models for developer housing cycle up or cycle down time as noted in this invention:

Description of Potential "Models" for Developer Housing Cycle Up Time a. Simple "Walking Average" Model—the control software would measure and track the last "N" developer housing cycle up times to construct a time-based model. The number of samples, N, could be "tuned" to control the accuracy of the model. (i.e. more samples provides greater accuracy).

b. Toner Age Model—through experimentation we could develop a mathematical model of the developer housing cycle up time based on toner age. In general, as the toner age increases, the time required to cycle up the developer housing would also increase. Temperature and RH conditions would also be factored into the model formula.

c. "Walking Average"+Toner Age Model—a more sophisticated model could consist of the Simple "Walking Average" model in (a) coupled with elements of the Toner Age model in (b) to produce a time-based model which is influenced by the toner age in the developer housing.

Obviously, any other suitable model may be used in addition to those of a, b, and c above. Items that can be considered when developing a model of this invention are age of toner and carrier, history of machine, media page sequence for imaging, usual cycle up time, toner degradation upon use and agitation, type of machine; i.e. four color stations or six color stations and times for each station to cycle up (activate) for examples station 1 (red) could usually take 10 seconds to cycle up whereas station 3 (yellow) could usually take 7 seconds to cycle up or down (inactivate). The models of this invention would give the user a "ready state" information on how much time to cycle up or cycle down each of the 4 to 6 color stations; each model will be different for each family of Xerographic machines.

Thus, this invention enables reduced toner material degradation by cycling down one or more color developer station(s) or housing(s) when not in use. Also, this invention provides improved machine availability and reduced service costs. Another benefit of this invention is it provides reduced toner consumption by reducing the need to purge toner. A further benefit of the present invention is that it reduces mechanical wear and tear by cycling down the developer housing(s) not in use. All of these benefits provide economical savings and substantial image improvements.

BRIEF DESCRIPTION OF THE DRAWINGS

FIG. 1 is an isomeric view of a six color station intermediate belt transfer Xerographic system where the six ROS color imaging stations are aligned along a transfer belt.

DETAILED DISCUSSION OF DRAWINGS AND PREFERRED EMBODIMENTS

There is known a color system 1, such as that of FIG. 1 where an array or series of different color imaging stations 5 are aligned above an endless belt 3. Each station 5 contains an upper positioned raster output scanner (ROS) 2 and below the ROS an imaging station 5 comprising a photoreceptor drum, color development station, and cleaning station. The ROS 2 emits an electronic beam 4 (laser) which impinges on the rotating photoconductive drum of station 5 thereby causing that location on the drum to undergo a change in electrical charge. For clarity, the entire station 5 is not illustrated, only a drum of each station 5 is shown. As the drum continues to rotate past the development station, toner particles of a color which is unique to that imaging station will attach to the drum at the location discharged by the ROS 2. This colored image is then transferred to an intermediate transfer belt 3 that is passing by, and in contact with, the photoreceptor drum. As the intermediate belt 3 passes by the different imaging stations (usually containing a different color), it picks up subsequent color layers to create a complete color image which is then transferred to a media.

In FIG. 1, a color imaging system 1 where the models of the present invention may be used is illustrated having an array (two or greater) of raster output scanners (ROS) 2 and their associated photoreceptor drums (which are part of the imaging stations aligned above an endless intermediate transfer belt 3). Each ROS emits a color image beam and each station 5 develops a different color image beam 4 on a photoconductive drum of an imaging station 5 rotates, the charged regions pick up toner of the color for that particular cycled up imaging station and transfer this color image to the surface of the belt 3 so that each colored image is deposited in relation to the previous deposited image. At the end of the process where all color stations are cycled up all six deposited images (that are color developed at each station) are precisely aligned to form the final color image which is eventually transferred to media. The arrows 7 indicate the rotation direction of drum of imaging station 5 and belt 3. At the location of actuator 8 the linear actuator 8 used in the present invention is generally shown as it communicates with the controller 10. Any number of sensors 9 may be used in the present invention as generally shown to monitor the use and alignment or misalignment of beams 4 and relay this information to controller 10. The controller 10 contains the software of the model of the present invention which tells the actuator 8 when to cycle up or cycle down each of the six different color imaging stations 5. When any of the stations 5 are not needed for that particular color run, it would be cycled down by the actuator 8 to preserve toner quality of that station.

In summary, this invention provides a Xerographic color system comprising a machine having from two to eight color stations, each color station comprising a different color toner, and a model with a controller and actuator configured to control and operate each said color stations. This model is configured to give cycle up or cycle down commands for each of said color stations to thereby provide each imaging run with selectivity as to which color station or stations will participate in that imaging run. This model is configured to maintain toner quality of each color station by preserving color characteristics by this selectivity. The model comprises information for that particular machine including information relative to developer and toner age, cycle up time for each station, cycle down time for such station, process history of the machine and machines of same family, temperature, RH (relative humidity) conditions, using average of number of sample runs of this machine.

The model is configured to predict a time required for the machine to achieve a ready state for the imaging run, and to convey information to the controller on what stations to cycle up or cycle down. The controller is in communication with an actuator and comprises software in accordance with information in the model. The cycle down commands result in an unused developer stations or housing(s) for this imaging run. The cycle up commands result in that developer station or housing(s) are being activated for the imaging run.

This Xerographic color system, as above noted, comprises a marking machine having from two to eight color stations, each color station comprising a different color toner, and a model with a sensor and a controller configured to control and separately operate each color station. The model is configured to maintain toner quality of each color station by preserving color characteristics by this selectivity. This selectivity and the model is configured to reduce degradation of toner in the cycled down color station(s). The selectivity and the model are also configured to cycle back up stations when a next imaging run would require the color toner of that station.

This model comprises information for that particular machine or family of machines, including developer and toner age, cycle up time for each station, cycle down time for each station, process history of said machine and machines of same family, temperature RH conditions, average of number of sample runs of said machine and mixtures thereof. The model is configured to predict a time required for the machine to achieve a ready state for its imaging run and to convey information to the controller and the actuator on what said stations to cycle up and cycle down. The cycle down commands result in unused developer housing(s) for that particular imaging run. The cycle up commands result in the cycled up developer housing(s) activated for that particular imaging run. The model is also configured to be usable in all machines of a family similar to the color system of the machine being used.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A xerographic color system comprising a machine having from two to eight color stations, each color station comprising a different color toner, a model with a controller configured to separately control and operate each said color station, said model configured to give cycle up or cycle down commands to said controller for each of said color stations to thereby provide each imaging run with selectivity as to which color station or stations will participate in said imaging run, said model configured to maintain toner quality and improved imaging of each color station by preserving color characteristics by said selectivity and wherein said model comprises information for that machine, relative to developer and toner age, cycle up time for each station, cycle down time for such station, process history of said machine, temperature, RH conditions, average of number of sample runs of said machine and mixtures thereof.

2. The color system of claim 1 wherein said model is configured to predict a time required for said machine to achieve a ready state for said imaging run.

3. The color system of claim 1 wherein said model is configured to convey information to said controller on what said stations to cycle up and cycle down, said controller comprising software in accordance with information in said model.

4. The color system of claim 1 wherein said cycle down commands result in an unused developer housing(s) for said imaging run.

5. The color system of claim 1 wherein said cycle up commands result in that developer housing(s) are activated for said imaging run.

6. A xerographic color system comprising a machine having from two to eight color stations, each color station comprising a different color toner, a model with a controller and actuator configured to separately control and operate each said control station, said model configured to give cycle up or cycle down commands for each of said color stations to thereby provide each imaging run with selectivity as to which color station or stations will participate in said imaging run, said model configured to maintain toner quality of each color station by preserving color characteristics by said selectivity, said selectivity and said model configured to reduce degradation of toner in said cycled down color station(s), said selectivity and said model also configured to cycle back up stations when a next imaging run would require the color toner of that station, and wherein said model comprises information for that machine, relative to developer and toner age, cycle up time for each station, cycle down time for each station, process history of said machine, temperature, relative humidity (RH) conditions, average of number of sample runs of said machine and mixtures thereof.

7. The color system of claim 6 wherein said model is configured to predict a time required for said machine to achieve a ready state for said imaging run.

8. The color system of claim 6 wherein said model is configured to convey information to said controller on what said stations to cycle up and cycle down.

9. The color system of claim 6 wherein said cycle down commands result in an unused developer housing(s) for that said imaging run.

10. The color system of claim 6 wherein said cycle up commands result in the cycled up developer housing(s) activated for said imaging run.

* * * * *